US009824835B2

(12) United States Patent
Yoshimatsu

(10) Patent No.: US 9,824,835 B2
(45) Date of Patent: Nov. 21, 2017

(54) KEY SWITCH HAVING JOINTED LINKS

(71) Applicant: FUJITSU COMPONENT LIMITED, Tokyo (JP)

(72) Inventor: Kazuya Yoshimatsu, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/276,949

(22) Filed: Sep. 27, 2016

(65) Prior Publication Data

US 2017/0092443 A1 Mar. 30, 2017

(30) Foreign Application Priority Data

Sep. 30, 2015 (JP) ..... 2015-195014

(51) Int. Cl.
*H01H 13/70* (2006.01)
*H01H 13/14* (2006.01)
*H01H 13/705* (2006.01)

(52) U.S. Cl.
CPC ..... *H01H 13/14* (2013.01); *H01H 13/705* (2013.01); *H01H 2215/00* (2013.01)

(58) Field of Classification Search
CPC ..... H01H 13/12; H01H 13/14; H01H 13/70; H01H 3/125
USPC ..... 200/5 A, 344
See application file for complete search history.

(56) References Cited

U.S. PATENT DOCUMENTS

| | | | | |
|---|---|---|---|---|
| 5,793,311 | A * | 8/1998 | Wood | G06F 3/02 200/181 |
| 6,618,239 | B2 * | 9/2003 | Takahashi | H01H 3/125 200/344 |
| 9,373,454 | B2 * | 6/2016 | Takemae | H01H 3/125 |
| 9,455,097 | B2 * | 9/2016 | Chen | H01H 3/125 |
| 2012/0229389 | A1 | 9/2012 | Nishino | |

FOREIGN PATENT DOCUMENTS

JP 2012-186061 9/2012

* cited by examiner

*Primary Examiner* — Vanessa Girardi
(74) *Attorney, Agent, or Firm* — IPUSA, PLLC

(57) ABSTRACT

A key-switch includes a keycap configured to be pressed down, a base member, and a link mechanism disposed between the keycap and the base member and configured to support the keycap such that the keycap is movable up and down relative to the base member, wherein the link mechanism includes four links arranged in a rectangular shape, and each of the links includes a sliding part configured to slide on the base member, a mounting part attached to the keycap, and joints connecting adjacent links among the four links together.

6 Claims, 12 Drawing Sheets

KEY SWITCH HAVING JOINTED LINKS

BACKGROUND OF THE INVENTION

1. Field of the Invention

The disclosures herein relate to a key-switch.

2. Description of the Related Art

Personal computers are provided with a keyboard serving as a data input apparatus. A keyboard has a plurality of key switches provided in one-to-one correspondence with the input characters and the like.

A certain type of key switch has two link members under the keycap, each of which has an engagement part formed on a lower side, and an upper side thereof rotatably connected to the keycap.

Upon the keycap being pressed by a finger or the like, the engagement parts of the link members which engage with each other cause the two link members to swing in conjunction with each other, thereby ensuring that the keycap is lowered and raised while maintaining a horizontal position thereof.

A key-switch that utilizes two link members to support a keycap requires that the pivot points to which the link members are rotatably connected be situated close to each other. As a result, the pivot points are arranged at the center of the keycap. In the configuration in which the link members support the center of the keycap, pressing the keycap at a point off the center causes the link members to be distorted, or causes the keycap to tilt around the pivot point, which gives rise to the problem of an unpleasant tactile key feel.

Accordingly, it may be desirable to provide an embodiment of a key-switch that provides an improved tactile key feel.

RELATED-ART DOCUMENTS

Patent Document

[Patent Document 1] Japanese Patent Application Publication No. 2012-186061

SUMMARY OF THE INVENTION

It is a general object of the present invention to provide a key-switch that substantially obviates one or more problems caused by the limitations and disadvantages of the related art.

According to an embodiment, a key-switch includes a keycap configured to be pressed down, a base member, and a link mechanism disposed between the keycap and the base member and configured to support the keycap such that the keycap is movable up and down relative to the base member, wherein the link mechanism includes four links arranged in a rectangular shape, and each of the links includes a sliding part configured to slide on the base member, a mounting part attached to the keycap, and joints connecting adjacent links among the four links together.

BRIEF DESCRIPTION OF THE DRAWINGS

Other objects and further features of the present invention will be apparent from the following detailed description when read in conjunction with the accompanying drawings, in which.

DESCRIPTION OF EMBODIMENTS

Figure 1:
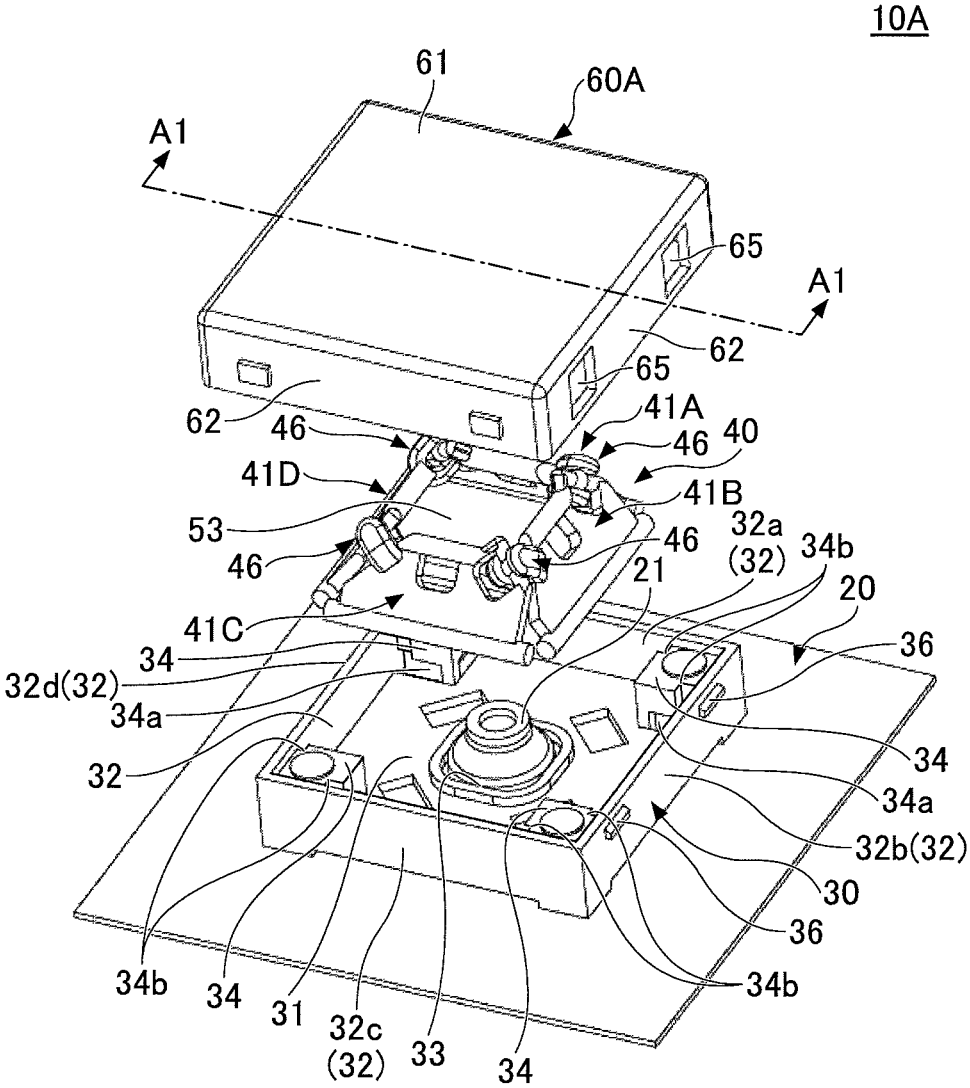
FIG. 1 is an exploded perspective view of a key-switch according to an embodiment.

In the following, various non-limiting embodiments of the present invention will be described with reference to the accompanying drawings.

In illustrations provided in the drawings, the same or corresponding members or elements are referred to by the same or corresponding numerals, and duplicate descriptions thereof will be omitted. Further, the drawings are not provided for the purpose of illustrating size ratios between members or elements unless otherwise specified.

Further, the embodiments that will be described hereinafter are examples only and not intended to limit the invention. Features and combinations thereof described in these embodiments may not necessarily be essential to the invention.

FIG. 1 is an exploded perspective view of an embodiment of a key-switch.

A key-switch 10A illustrated in FIG. 1 includes a membrane switch 20, a base member 30, a link mechanism 40, and a keycap 60A.

The membrane switch 20 includes an upper layer having an upper electrode formed thereon, a lower layer having a lower electrode formed thereon to face the upper electrode, and a spacer providing spacing between the upper layer and the lower layer. The upper electrode and the lower electrode constitute a switch. The switch has a rubber actuator 21 disposed thereon.

Upon the keycap 60A being pressed, the rubber actuator 21 presses the switch, thereby placing the switch in an "on" state. Upon the keycap 60A being released, the rubber actuator 21 returns to its original position, thereby placing the switch in an "off" state. The rubber actuator 21 also serves to provide a clicking feel to an operator when the operator presses down the keycap.

The base member 30, which has a rectangular shape, supports the keycap 60A through the link mechanism 40. The base member 30, which is a unitary, seamless structure made of resin, includes a base 31, lateral walls 32, an opening 33, and brace struts 34.

The base member 30 is disposed on the membrane switch 20. The base member 30 has the opening 33 at the center thereof through which the rubber actuator 21 passes. The walls 32, which are individually designated as 32*a*, 32*b*, 32*c*, and 32*d*, stand on the perimeter of the base member 30. The two walls 32*b* and 32*d* that face each other have projections 36 formed thereon.

Figure 7A:
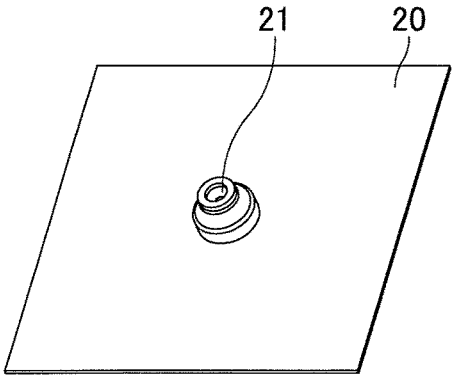
FIGS. 7A through 7E are perspective views illustrating a method of assembling the key-switch according to the embodiment.
Figure 7B:
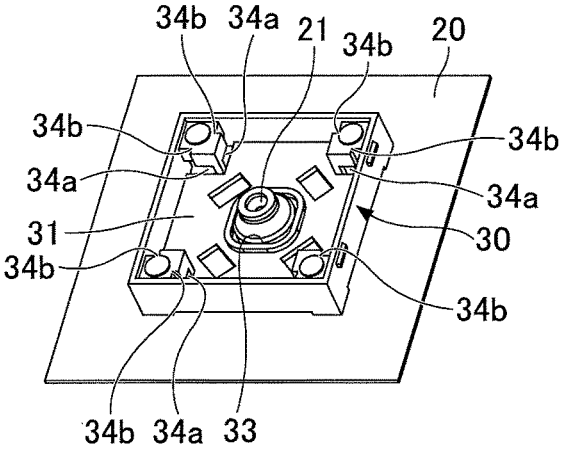
Figure 7C:
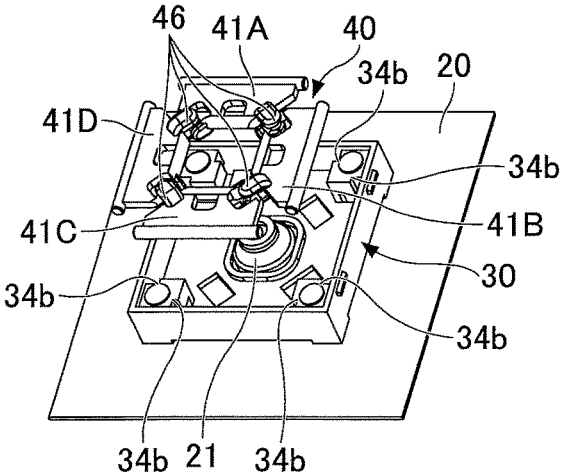

The brace struts 34, each of which is a rectangular prism, are disposed at the four corners of the base member 30 as illustrated in FIG. 1 and FIG. 7C. Each of the brace struts 34 has guide grooves 34*a* and insertion grooves 34*b* formed thereon.

A guide groove 34*a* and a corresponding insertion groove 34*b* communicate with each other to form a letter-L shape. The guide grooves 34*a* extend along the base 31 at the lower ends of the brace struts 34, and the insertion grooves 34*b* extend vertically on the brace struts 34 along the walls 32. A guide groove 34*a* and a corresponding insertion groove 34*b* formed on a brace strut 34 are situated to face the guide groove 34*a* and the insertion groove 34*b*, respectively, formed on an adjacent brace strut 34 (see FIG. 7B).

In the following, a description will be given of the link mechanism 40 with reference to FIG. 1 as well as FIGS. 2A and 2B through FIGS. 6A and 6B.

Figure 2B:
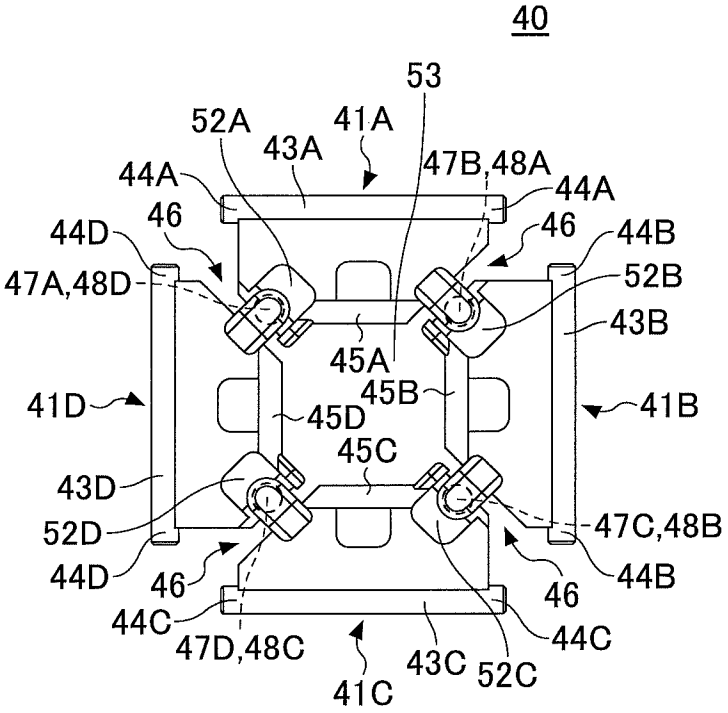
FIGS. 2A and 2B are plan views of a link mechanism in an unconnected state and in a connected state, respectively.
Figure 2A:
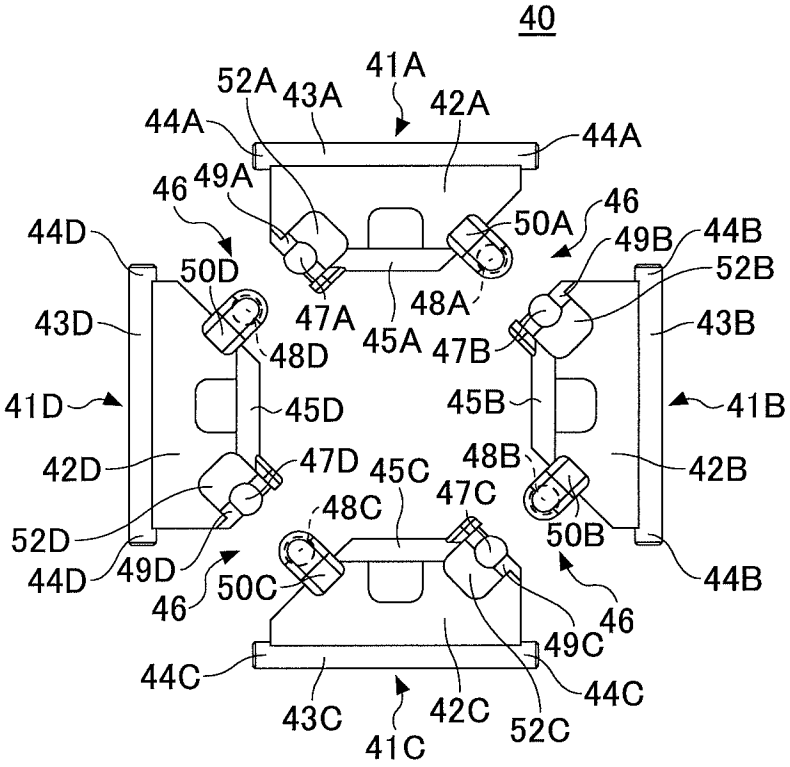
Figure 3A:
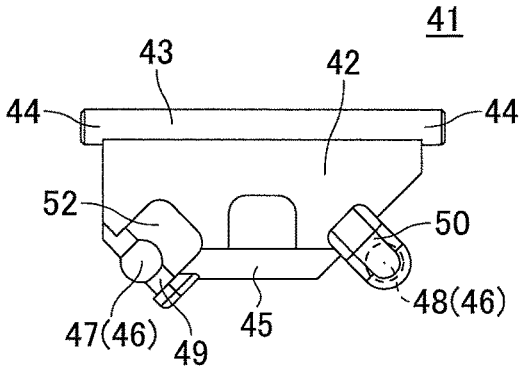
FIGS. 3A through 3D are a plan view, a front view, a bottom view, and a lateral view, respectively, each of which illustrates a link.
Figure 3B:
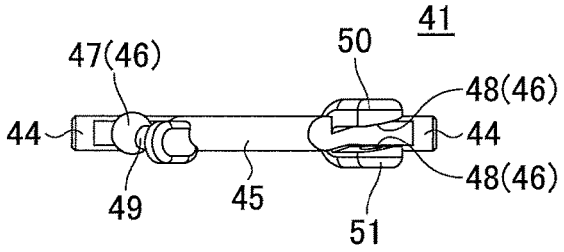
Figure 3C:
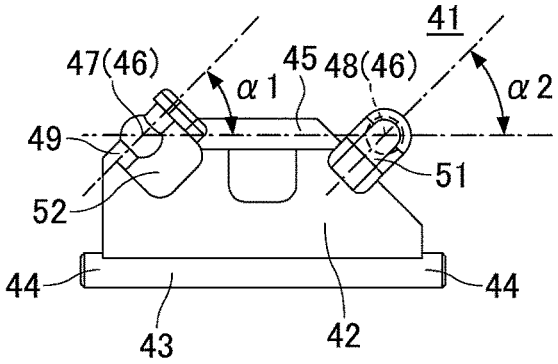
Figure 3D:
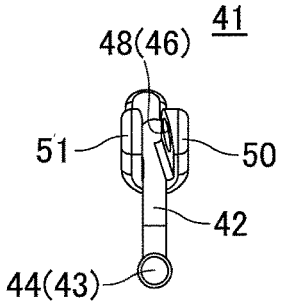
Figure 4A:
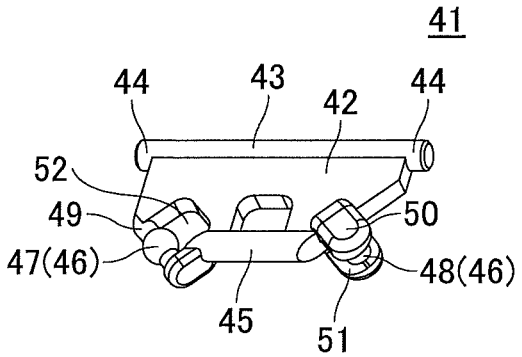
FIGS. 4A through 4C are a perspective top view, a perspective bottom view, and a perspective bottom view from a different angle, respectively, each of which illustrates a link.
Figure 4C:
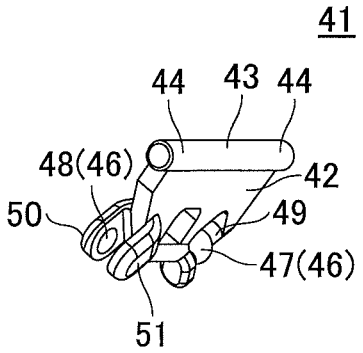
Figure 4B:
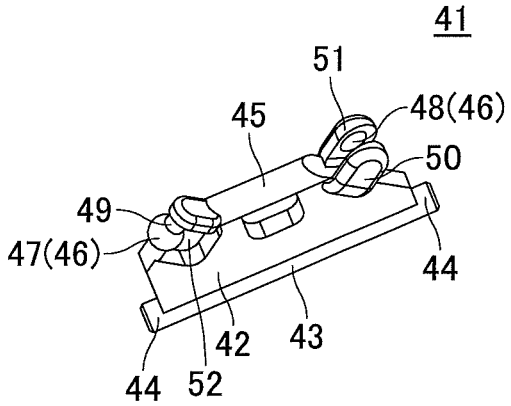
Figure 5B:
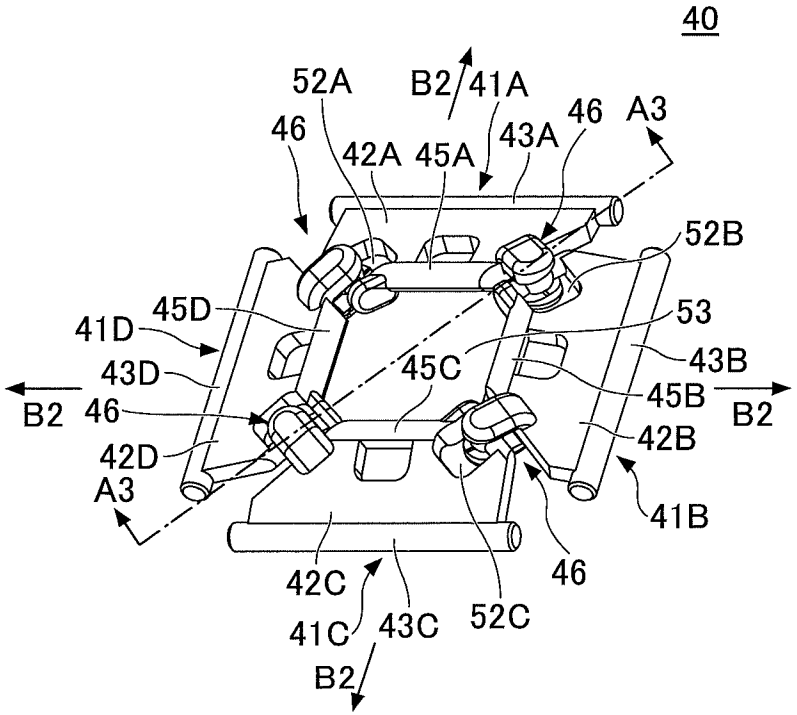
FIGS. 5A and 5B are perspective views of the link mechanism in a non-operating state and in an operating state, respectively.
Figure 5A:
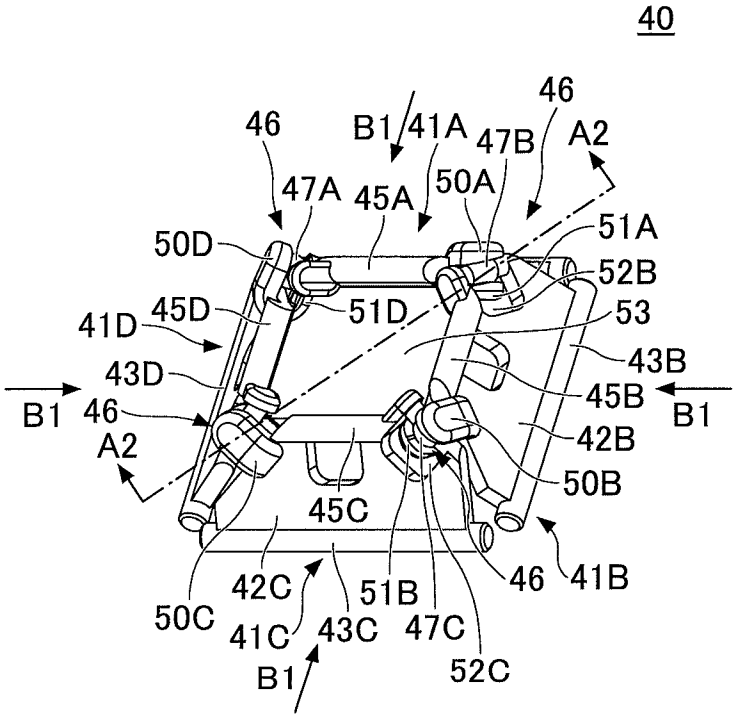
Figure 6B:
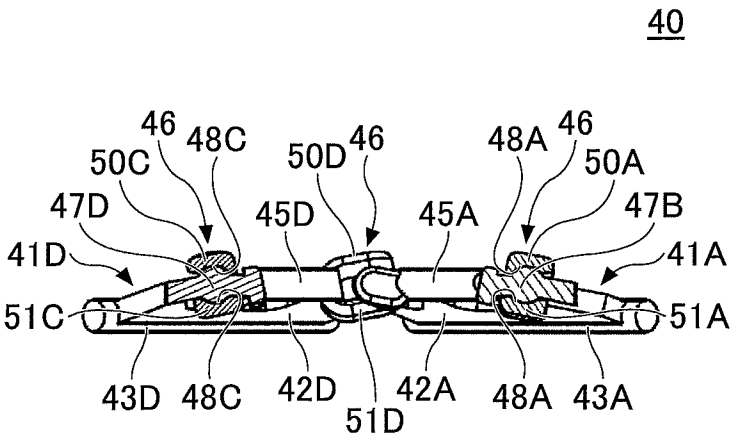
FIGS. 6A and 6B are cross-sectional views of the link mechanism in the non-operating state and in the operating state, respectively.
Figure 6A:
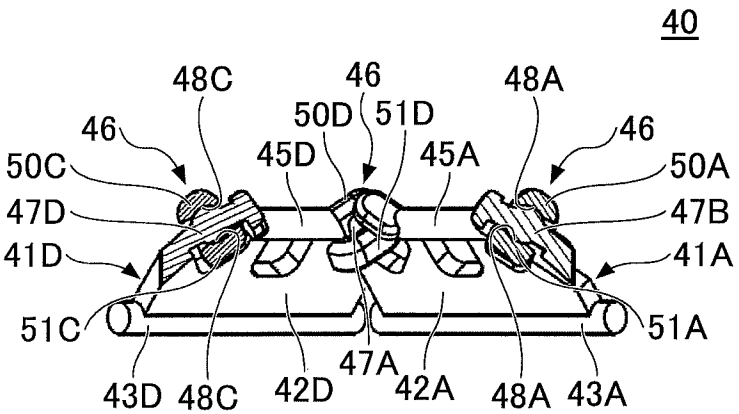

FIGS. 2A and 2B are plan views of the link mechanism. FIGS. 3A through 3D and FIGS. 4A and 4C are drawings illustrating a link. FIGS. 5A and 5B are oblique perspective views of the link mechanism. FIGS. 6A and 6B are cross-sectional views of the link mechanism.

The link mechanism 40 is disposed between the base member 30 and the keycap 60A to cause the keycap 60A to move up and down relative to the base member 30. The link mechanism 40 has four links 41A through 41D.

In this embodiment, all the links 41 have the same shape. In the following, individual links are referred to as the links 41A through 41D, and a representative link is referred to as a link 41. Further, four links 41A through 41D are collectively referred to as links 41. Other elements described hereafter maybe referred to in a similar way.

In the following, the direction in which the keycap 60A moves up and down relative to the base member 30 is referred to as an up-and-down direction. The direction in which the keycap 60A moves toward the base member 30 is referred to as a downward direction, and the direction in which the keycap 60A moves away from the base member 30 is referred to as an upward direction.

The links 41 are disposed to face the four walls 32 of the base member 30, respectively. The links 41 are arranged to form a square or rectangular shape in a plan view as illustrated in FIGS. 2A and 2B.

As illustrated in FIGS. 3A through 3D and FIGS. 4A through 4C, the link 41 is a plate-shaped member, which includes a main body 42, a sliding part 43, an engaging part 44, a mounting part 45, and joints 46. The link 41 has great strength against distortion due to the use of the plate-shaped member.

The main body 42, which is trapezoid shaped, has the sliding part 43 at the bottom side and the mounting part 45 at the top side. The main body 42, the sliding part 43, and the mounting part 45 are integrally formed. The sliding part 43 and the mounting part 45 are cylindrical. The ends of the sliding part 43 have engaging parts 44 projecting outwardly from the main body 42.

The joints 46, which serve to connect the adjacent link 41 with each other, are either a convex part 47 having a spherical shape or a concave part 48.

The convex part 47 is disposed at one end of the mounting part 45. A support part 49 supports two opposite ends of the convex part 47. An opening 52 is in existence between the convex part 47 and the main body 42. The angle $\alpha 1$ illustrated in FIG. 3C at which the longitudinal direction of the mounting part 45 is arranged relative to the direction of extension of the support part 49 is set to 45 degrees.

The concave part 48 is formed in the inner faces of arms 50 and 51 that face each other. The arms 50 and 51 are disposed at an opposite end of the mounting part 45 from the end at which the convex part 47 is disposed.

The two faces of the concave part 48 formed on the arms 50 and 51, respectively, face each other to form a substantially spherical space therebetween. This spherical space has a diameter equal to the diameter of the convex part 47. The convex part 47 engages with the concave part 48 formed on the arms 50 and 51 such as to be rotatable inside the concave part 48. The angle $\alpha 2$ illustrated in FIG. 3C at which the longitudinal direction of the mounting part 45 is arranged relative to the direction of extension of the arms 50 and 51 is set to 45 degrees.

In order to assemble the link mechanism 40, the links 41 are arranged in a square shape as illustrated in FIG. 2A. In this arrangement, the sliding parts 43 are situated toward the outside, and the mounting parts 45 shorter than the sliding parts 43 are situated toward the inside.

Subsequently, the convex parts 47A, 47B, 47C, and 47D of the links 41 engage with the concave parts 48D, 48A, 48B, and 48C of the adjacent links 41 at the positions of the four joints 46. The convex part 47B of the link 41B is inserted into the concave part 48A of the adjacent link 41A to connect the link 41A and the link 41B. The link 41B, the link 41C, and the link 41D are similarly connected with the link 41C, the link 41D, and the link 41A, respectively.

FIGS. 5A and 5B and FIGS. 6A and 6B illustrate the link mechanism 40 in the assembled state in which the links 41 are connected together.

FIG. 5A and FIG. 6A illustrate the link mechanism 40 in the state in which the keycap 60A is not pressed down (hereinafter referred to as a "non-operating state"). FIG. 5B and FIG. 6B illustrate the link mechanism 40 in the state in which the keycap 60A is pressed down (hereinafter referred to as an "operating state"). FIG. 6A is a cross-sectional view of the link mechanism 40 taken along the line A2-A2 in FIG. 5A. FIG. 6B is a cross-sectional view of the link mechanism 40 taken along the line A3-A3 in FIG. 5B.

As illustrated in FIGS. 5A and 5B, the links 41 are connected together through the joints 46 so that the four mounting parts 45 constitute the four sides of a square. Namely, a square space 53 is formed by the mounting parts 45.

On the other hand, the sliding parts 43 are not connected together. An upward movement of the mounting parts 45 thus causes the sliding parts 43 to move inwardly in the directions indicated by arrows B1 as illustrated in FIG. 5A. Further, a downward movement of the mounting parts 45 causes the sliding parts 43 to move outwardly in the directions indicated by arrows B2 as illustrated in FIG. 5B.

As illustrated in FIGS. 6A and 6B, the convex parts 47B and 47D are placed between the arms 50A and 50C and the arms 51A and 51C, respectively. The convex parts 47B and 47D have the same radius as the concave parts 48A and 48C. With this arrangement, the convex parts 47 rotate inside the concave parts 48. Accordingly, the convex parts 47 do not disengage from the arms 50 and 51 despite the up and down movements of the mounting parts 45A through 45D.

When the mounting parts 45 move, the arms 50 and arms 51 move around the convex parts 47. Since the openings 52 (52A through 52D) formed in the main bodies 42 (42A through 42D) in the vicinity of the convex parts 47 (47A through 47D) accommodate the arms 50 and 51, the arms 50 and 51 do not come in contact with the main body 42 of the adjacent link.

Figure 8:
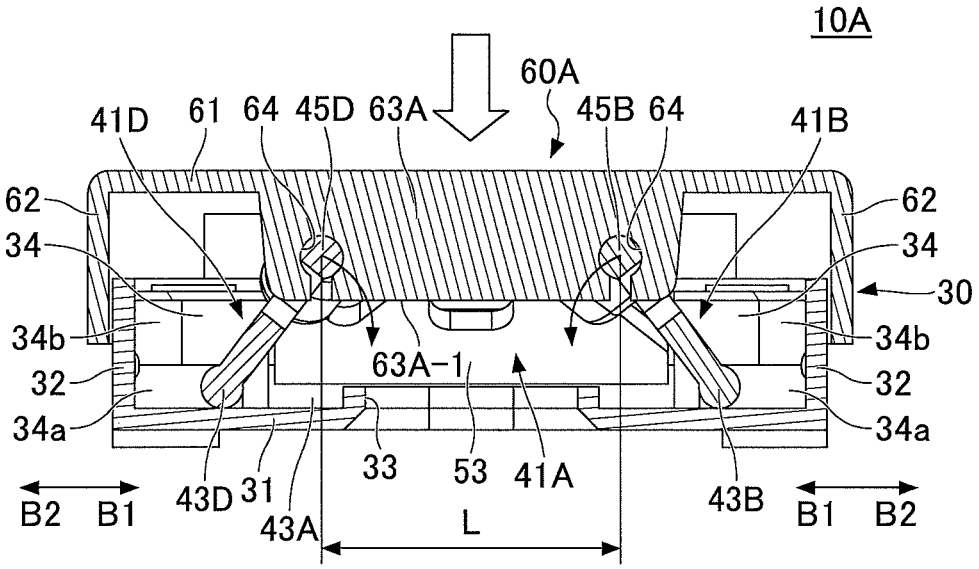
FIG. 8 is a cross-sectional view of the key-switch in the non-operating state according to the embodiment.

The keycap 60A is pressed by an operator when the key-switch 10A is operated. As illustrated in FIG. 8, the keycap 60A includes an upper plate 61, lateral walls 62, and a projection 63A.

The upper plate 61 is rectangular. The walls 62 extend from the four sides of the perimeter of the upper plate 61 toward the base member 30. Engagement holes 65 are formed in the walls 62 at the positions corresponding to the projections 36 formed on the base member 30.

The engagement holes 65 engage with the projections 36 when the keycap 60A is attached to the base member 30. The engagement holes 65 have a prolonged shape extending along the direction in which the keycap 60A is pressed. The length of the engagement holes 65 in the direction in which the keycap 60A is pressed is substantially equal to the length of the stroke of the keycap 60A observed when the keycap 60A is pressed. Engagement of the projections 36 with the engagement holes 65 allows the keycap 60A to move up and down relative to the base member 30 while preventing the keycap 60A from disengaging from the base member 30.

FIG. 8 is a cross-sectional view of the assembled key-switch 10A taken along the line A1-A1 in FIG. 1. The projection 63A is formed on the back face of the upper plate 61 to extend toward the base member 30 as illustrated in FIG. 8.

The projection 63A has four axial bores 64 formed at the lower portion thereof at the positions corresponding to the mounting parts 45. The mounting parts 45 engage with the axial bores 64 in a rotatable manner. The engagement of the mounting parts 45 with the axial bores 64 causes the keycap 60A to be connected to the link mechanism 40.

With the use of the four links 41A through 41D, the four mounting parts 45A through 45D are arranged in a square or rectangular shape in a plan view when the links 41 are connected together. In comparison with the case in which only two links are used, the spacing between the axial bores 64 engaging with the mounting parts 45, i.e., the spacing between the pivot points of the mounting parts 45, can be set wider than in the gear-link-type key-switch that utilizes two links to support a keycap.

In the following, a method of assembling the key-switch 10A will be described by referring to FIGS. 7A through 7E.

FIG. 7A illustrates the membrane switch 20 on which the rubber actuator 21 is disposed. The membrane switch 20 has a large number of switches, which correspond to the positions at which the rubber actuators 21 are disposed. FIGS. 7A through 7E show only one rubber actuator 21 for the sake of convenience.

The base member 30 is disposed on the membrane switch 20 as illustrated in FIG. 7B. In so doing, the base member 30 is aligned such that the rubber actuator 21 is inserted into the opening 33. When the base member 30 is attached to the membrane switch 20, the rubber actuator 21 projects from the base 31. The method of mounting the base member 30 to the membrane switch 20 is not limited to any particular method, and adhesive may be used, for example.

The link mechanism 40 having the four links connected together is then attached to the brace struts 34. In order to mount the link mechanism 40 to the brace struts 34, the engaging parts 44 formed at the opposite ends of the sliding parts 43 are inserted into the insertion grooves 34*b* of the brace struts 34. The engaging parts 44 engage with the guide grooves 34*a* when inserted into the lower end of the insertion grooves 34*b*.

Figure 7D:
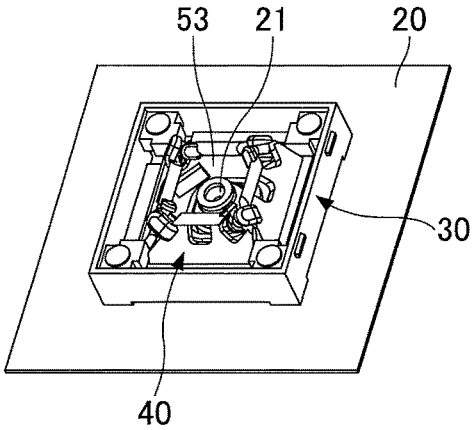
Figure 7E:
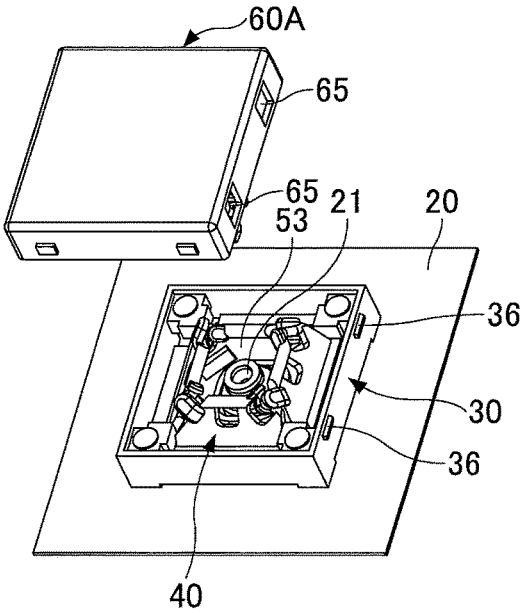

The engagement of the engaging parts 44 with the guide grooves 34*a* causes the link mechanism 40 to be mounted to the base member 30. FIG. 7D illustrates the link mechanism 40 mounted to the base member 30. With the link mechanism 40 mounted to the base member 30, the engaging parts 44 are guided along the guide grooves 34*a*, so that the sliding parts 43 are movable on the base 31 in the inward direction and the outward direction as illustrated by the arrows B1 and B2. In this movement, the sliding parts 43 slide on the base 31 while being in contact therewith, which ensures a stable sliding movement of the sliding parts 43.

After mounting the link mechanism 40 to the base member 30, the keycap 60A is attached to the link mechanism 40. In order to mount the keycap 60A to the link mechanism 40, the keycap 60A is pressed toward the base member 30 so that the mounting parts 45 are inserted into the axial bores 64. At the same time, the projections 36 of the base member 30 are engaged with the engagement holes 65. With this arrangement, the keycap 60A is attached to the link mechanism 40 and to the base member 30.

With the keycap 60A attached to the link mechanism 40, the rubber actuator 21 projecting at the center of the base member 30 is in contact with a bottom face 63A-1 of the projection 63A illustrated in FIG. 8, so that the elastic force of the rubber actuator 21 urges the keycap 60A upwards. In the manner described above, the keycap 60A is mounted to the link mechanism 40 and to the base member 30.

In the following, a description will be given of the operation of the key-switch 10A.

The key-switch 10A in the non-operating state will be described first. FIG. 8 illustrates the key-switch 10A in the non-operating state.

Figure 10A:
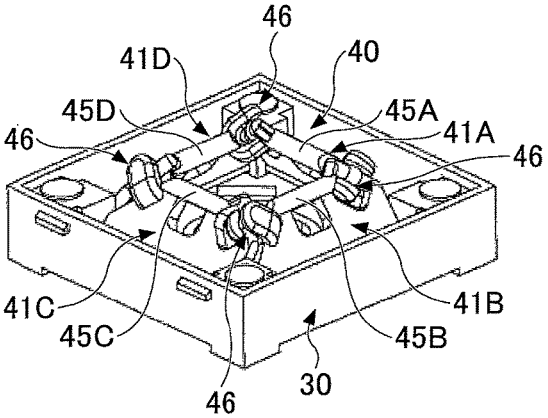
FIGS. 10A and 10B are perspective views of the link mechanism disposed on the base member as appear in the non-operating state and in the operating state, respectively.

In the non-operating state, the keycap 60A is urged upward by the elastic force of the rubber actuator 21. As a result, the mounting parts 45 are situated upward and project upward from the base member 30 as illustrated in FIG. 10A. Further, when the mounting parts 45 are situated upward, the sliding parts 43 are situated inwardly while being guided along the guide grooves 34*a*.

In the non-operating state, the projections 36 are in contact with the lower edge of the engagement holes 65. Because of this restriction, the keycap 60A urged by the rubber actuator 21 do not move further upward.

When an operator presses down the keycap 60A in the direction of the arrow illustrated in FIG. 8, the keycap 60A moves downward despite the elastic force of the rubber actuator 21.

Figure 9:
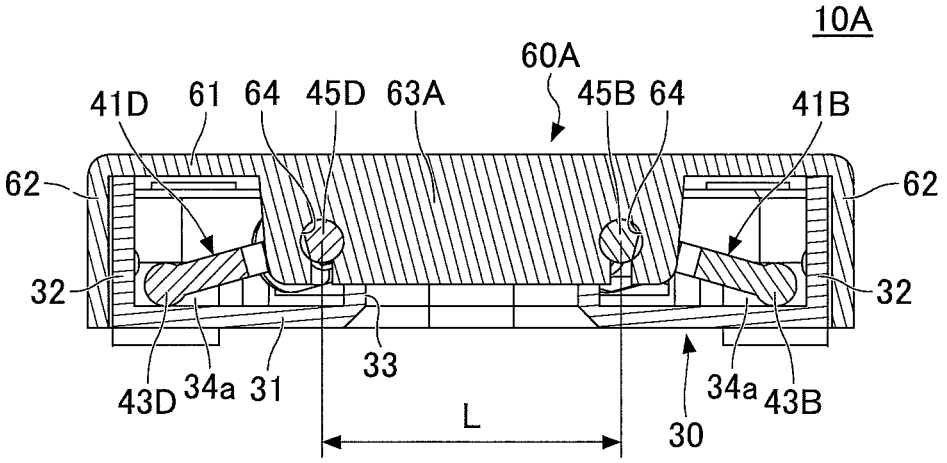
FIG. 9 is a cross-sectional view of the key-switch in the operating state according to the embodiment.
Figure 10B:
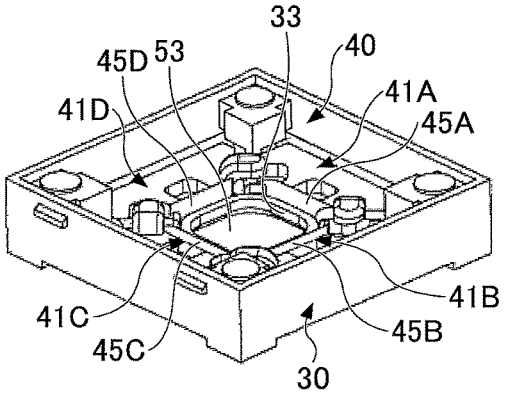

FIG. 9 and FIG. 10B illustrate the keycap 60A pressed downward to its lowest position.

In the operating state, the keycap 60A presses the switch of the membrane switch 20 through the rubber actuator 21. As a result, the switch corresponding to the operated keycap 60A is turned on.

Further, pressing the keycap 60A also causes the mounting parts 45 to move downward. As the mounting parts 45 move downward, the engaging parts 44 are guided along the guide grooves 34*a*, so that the sliding parts 43 slide on the base 31 outwardly in the 32 direction.

When the operator stops pressing and releases the keycap 60A, the elastic force of the rubber actuator 21 moves the link mechanism 40 in the opposite direction from the time of pressing, so that the keycap 60A moves upward to return to the non-operating state.

As previously described, the key-switch 10A of the present embodiment has the four links arranged in a square or rectangular shape to support the keycap 60A. The square-shaped arrangement of the mounting parts 45 allows the spacing between the mounting part 45A and the opposite mounting part 45C and the spacing between the mounting part 45B and the opposite mounting part 45D to be set longer than in the gear-link-type key-switch in which the gears formed at the upper ends of the two links are engaged with each other. It may be noted that the distance between the mounting part 45B and the mounting part 45D is indicated by an arrow L in FIG. 8 and FIG. 9. As a result, the spacing between the axial bores 64 in engagement with the mounting parts 45 can also be widened, thereby allowing the links 41 to support the keycap 60A in a more stable manner.

Since the spacing between the opposite mounting parts 45A and 45C and the spacing between the opposite mounting parts 45B and 45D are widened, the pivot points of the mounting parts 45 can be situated off the center of the keycap 60A. With the pivot points situated off the center of the keycap 60A, irregular movement of the keycap 60A due to looseness is avoided even when the operator presses a portion of the keycap 60A off the center thereof.

As was previously described, the mounting parts 45 are arranged in a square or rectangular shape when the links 41 are connected together through the joints. Because of this, these links are free from distortion when the keycap 60A supported by the links is pressed down.

The connection of the four links through the joints 46 causes the links 41 to move in conjunction with each other when the keycap 60A moves up and down. This arrangement ensures that the keycap 60A moves in a stable manner without tilting.

In the state in which the keycap 60A is pressed down to its lowest position, the links 41 are placed flat in contact with the base 31 of the base member 30 as illustrated in FIG. 10B. This arrangement ensures a sufficient stroke length for the keycap 60A while enabling the thinning of the key-switch 10A.

In the following, a second embodiment will be described.

Figure 11:
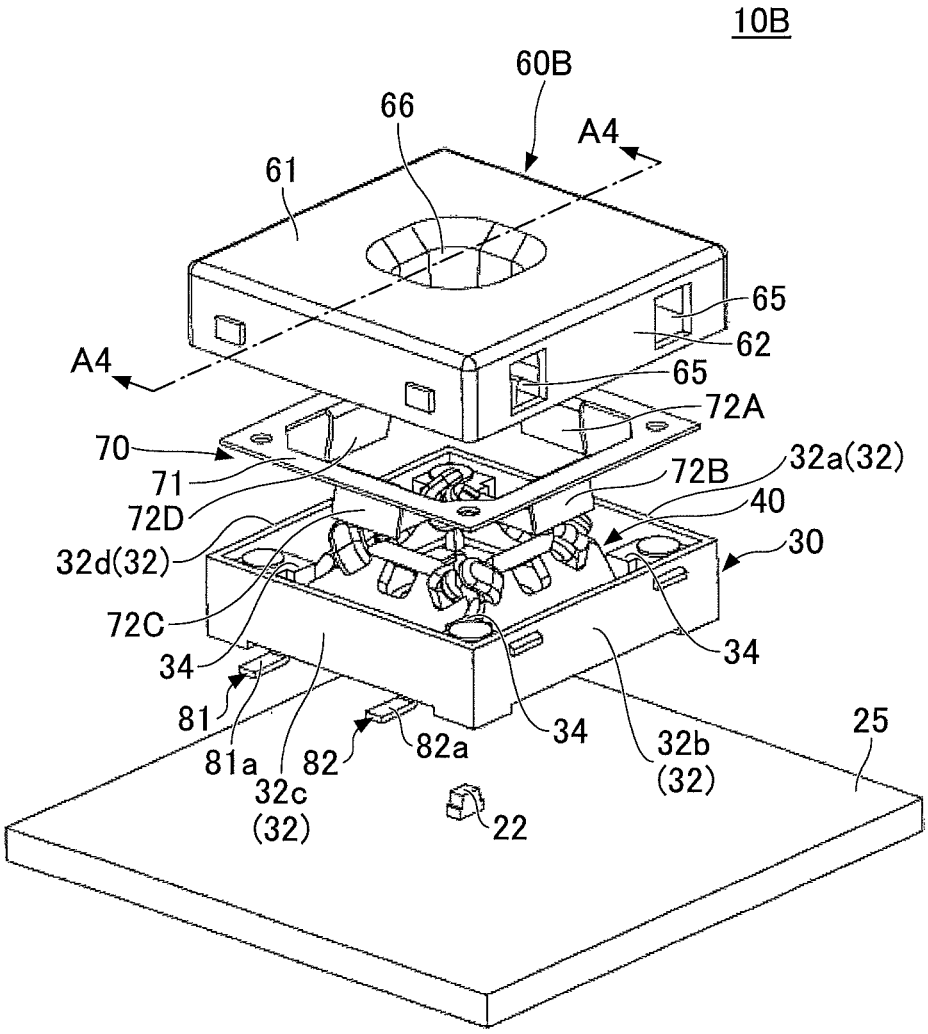
FIG. 11 is an exploded perspective view of a key-switch according to a second embodiment.
Figure 12:
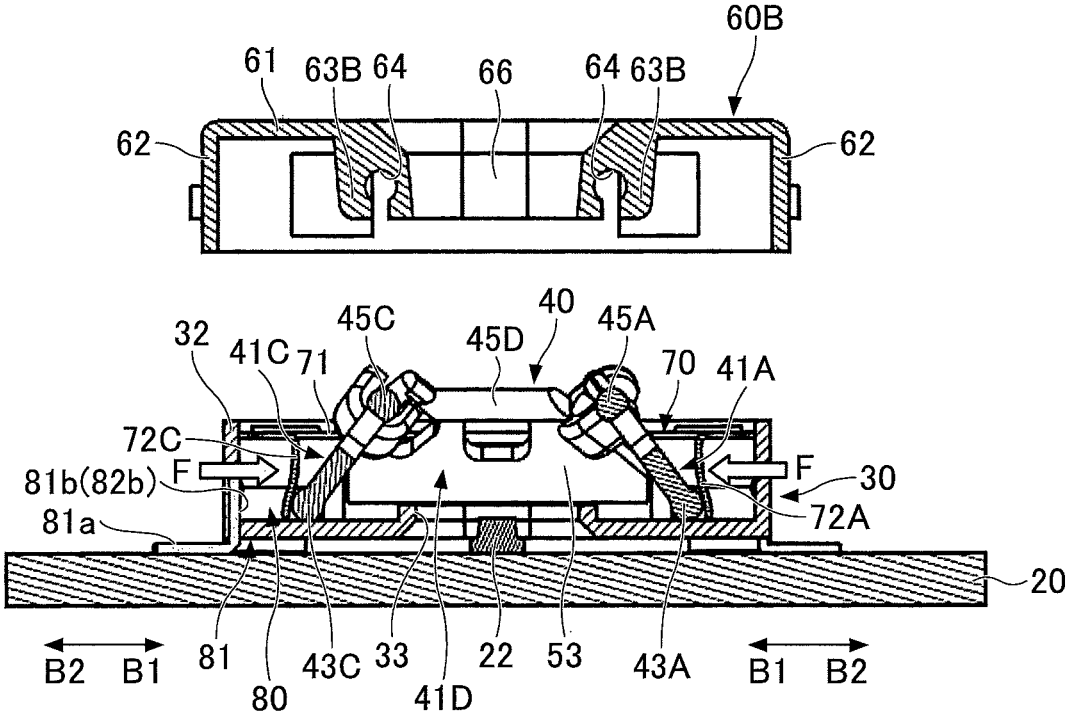
FIG. 12 is a cross-sectional view of the key-switch in the non-operating state according to the second embodiment.
Figure 13:
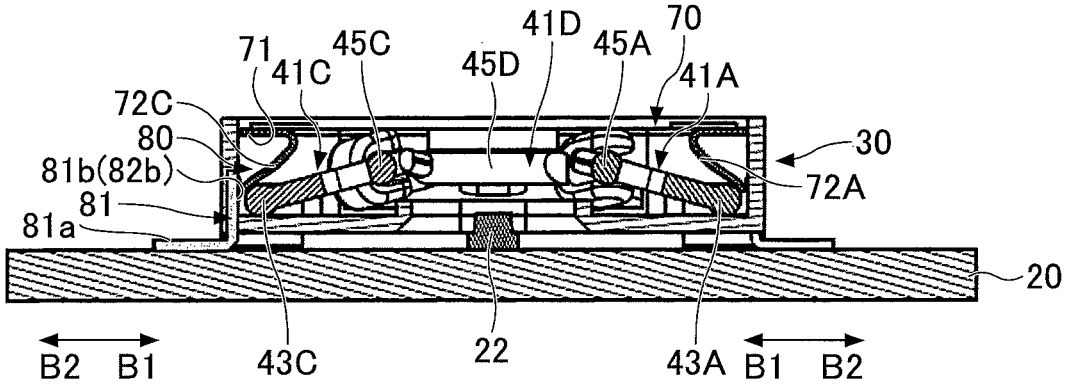
FIG. 13 is a cross-sectional view of the key-switch in the operating state according to the second embodiment.

FIG. 11 through FIGS. 14A through 14F are drawings illustrating a key-switch 10B according to the second embodiment. FIG. 11 is an exploded perspective view of the key-switch 10B. FIG. 12 is a cross-sectional view of the key-switch 10B in the non-operating state. FIG. 13 is a cross-sectional view of the key-switch 10B in the operating state. FIGS. 14A through 14F are perspective views illustrating a method of making the key-switch 10B. In FIG. 11 through FIGS. 14A through 14F, the same or corresponding elements as those of FIGS. 1 through 10 are referred to by the same numerals, and a description thereof will be omitted as appropriate.

In the present embodiment, a circuit board 25 is used as a substrate of the key-switch 10B. The area of the circuit board 25 where the base member 30 is disposed has an LED 22 serving as a light emitting device.

One of the walls of the base member 30 (the wall 32*c*) has a pair of terminals 81 and 82 disposed thereon. Each of the terminals 81 and 82 has an letter-L shape, and has mounting portions 81*a* and 82*a* and contacts 81*ba* and 82*b* (see FIG. 12). The contact 81*b* and the contact 82*b* are disposed on the wall 32*c* and spaced apart from each other to avoid contact therebetween.

The mounting portions 81*a* and 82*a* extend outwardly from the base of the base member 30. The contacts 81*b* and 82*b* extend vertically on the inner surface of the wall 32 as illustrated in FIG. 12.

The key-switch 10B of the present embodiment has no rubber actuator 21, and instead utilizes a spring 70 to urge the link mechanism 40 and a keycap 60B upward. The spring 70 is made of metal having a spring property and electrical conductivity. The spring 70 includes a frame 71 and arms 72A through 72D that are seamlessly formed with the frame 71.

The frame 71, which has a square frame shape, is fixedly mounted to the upper ends of the brace struts 34. The manner of mounting the frame 71 to the brace struts 34 is not limited to a particular method. Screw thread mounting may be used, for example. Alternatively, the frame 71 may be attached through welding.

The arms 72A through 72D are formed on the respective sides of the frame 71. The four arms 72 extend downwardly from the respective sides of the frame 71.

As illustrated in FIG. 12, the spring 70 attached to the base member 30 has the arm 72A in contact with the sliding part 43A, and has the arm 72C in contact with the sliding part 43C. Although not illustrated in FIG. 12, the arm 72B is in contact with the sliding part 43B, and the arm 72D is in contact with the sliding part 43D.

The arms 72 elastically deform due to contact with the sliding parts 43, respectively, thereby urging the corresponding sliding parts 43 inwardly in the B1 directions. The elastic forces of the arms 72 cause the corresponding sliding parts 43 to move inwards on the base 31 while the engaging parts 44 are guided along the guide grooves 34*a* (see FIG. 14B). As a result, the mounting parts 45 are situated upward in the non-operating state.

With respect to the wall 32 having the terminals 81 and 82 disposed thereon, the arm 72C is situated to face the contacts 81*ba* and 82*b*. The terminals 81 and 82 and the arm 72C constitute an electrical switch, and are disposed on the wall 32 so as not to be in contact with each other in the non-operating state. The arm 72C comes in contact with the terminals 81 and 82 to couple the terminals 81 and 82 with each other, resulting in the key-switch 10B being placed in the conductive state. The arm 72C then separates from the terminals 81 and 82, resulting in the key-switch 10B being placed in the nonconductive state.

The keycap 60B has a light-transmissive opening 66. The opening 66 is formed through the upper plate 61 and a projection 63B. The opening 66 faces the LED 22 disposed on the circuit board 25 when the keycap 60B is attached on the base member 30.

In the following, a method of assembling the key-switch 10B will be described by referring to FIGS. 14A through 14F.

Figure 14A:
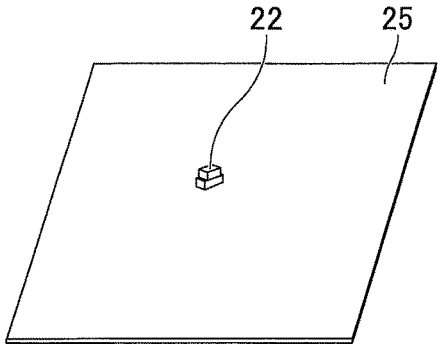
FIGS. 14A through 14F are perspective views illustrating a method of assembling the key-switch according to the second embodiment.

FIG. 14A illustrates the circuit board 25 on which the LED 22 is disposed. The LED 22 disposed at the position of the circuit board 25 at which the key-switch 10B is arranged, and also has electrodes (not shown) disposed at the positions corresponding to the mounting portions 81*a* and 82*a* of the terminals 81 and 82. A plurality of LEDs 22 and electrodes are disposed on the circuit board 25. FIG. 14A, however, illustrates only one LED 22 for the sake of convenience.

Figure 14B:
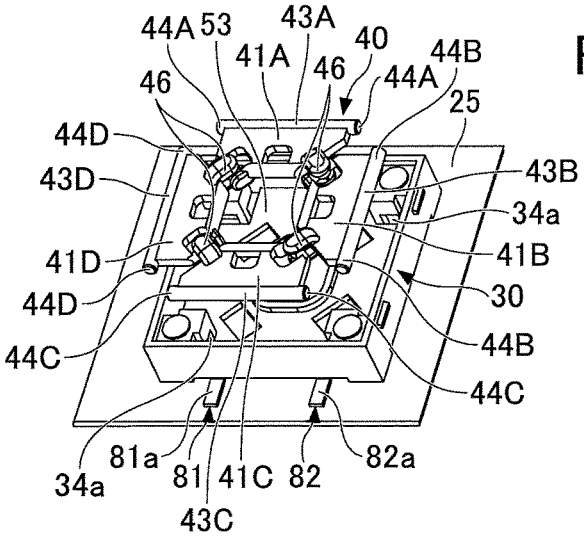

The base member 30 is disposed on the circuit board 25 as illustrated in FIG. 14B. When the base member 30 is disposed on the circuit board 25, the LED 22 is inserted into the opening 33. The LED 22 thus projects from the base 31 of the base member 30. The mounting portions 81*a* and 82*a* of the terminals 81 and 82 are solder-mounted to the electrodes formed on the circuit board 25.

Figure 14C:
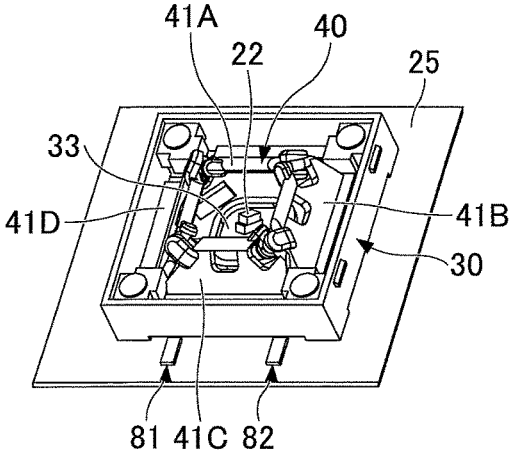

After the base member 30 is attached to the circuit board 25, the engaging parts 44 are engaged with the guide grooves 34*a* of the brace struts 34, thereby mounting the link mechanism 40 to the base member 30 as illustrated in FIG. 14B and FIG. 14C.

Figure 14D:
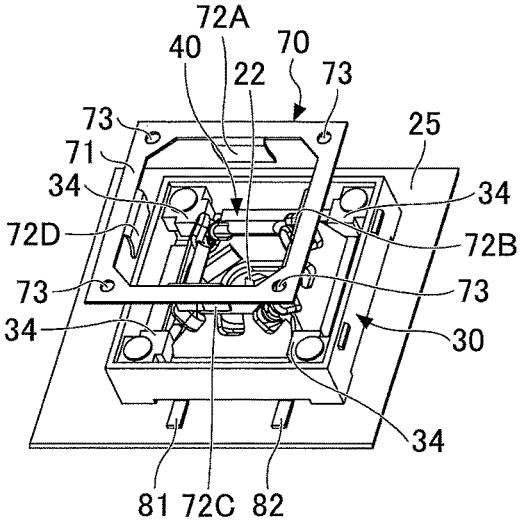
Figure 14E:
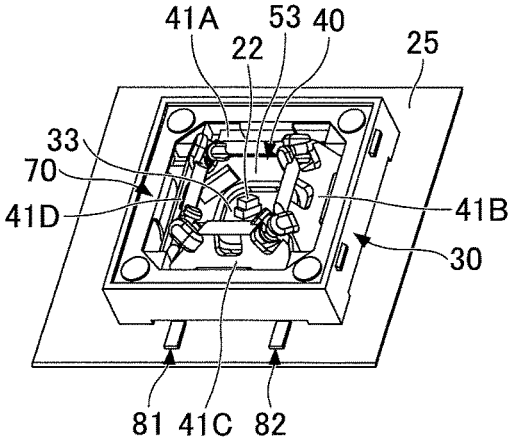
Figure 14F:
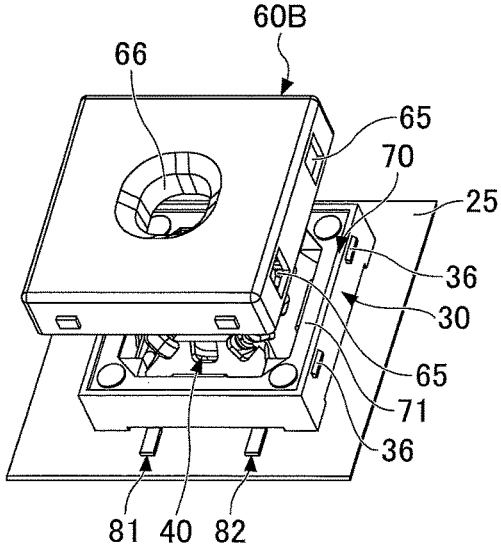

Subsequently, the spring 70 is disposed on the base member 30 and the link mechanism 40 mounted thereto as illustrated in FIG. 14D. In order to attach the spring 70 to the base member 30, the four corners of the spring 70 are fixedly mounted to the top of the brace struts 34 as illustrated in FIG. 14E.

With the spring 70 fixedly mounted to the base member 30, the arms 72 are in contact with the corresponding sliding parts 43, respectively. The arms 72 inwardly urge the sliding parts 43, respectively, so that the mounting parts 45 move upward as illustrated in FIG. 14E from the state illustrated in FIG. 14D. With respect to the wall 32 having the terminals 81 and 82 disposed thereon, the arm 72C faces the contacts 81*ba* and 82*b*.

After mounting the spring 70 to the base member 30, the keycap 60B is attached to the link mechanism 40. Since the link mechanism 40 has a space 53 at the center, the opening 66 is situated directly above the LED 22 when the keycap 60B is attached to the link mechanism 40.

In the manner described above, the keycap 60B is mounted to the link mechanism 40 and to the base member 30.

In the following, a description will be given of the operation of the key-switch 10B.

The key-switch 10B in the non-operating state will be described first. FIG. 12 illustrates the key-switch 10B in the non-operating state. For the sake of convenience of illustration, FIG. 12 illustrates the key-switch 10B in which the keycap 60B is detached from the link mechanism 40.

In the non-operating state, the elastic forces of the arms 72 inwardly urge the sliding parts 43 in the B1 directions, so that the mounting parts 45 are situated upward. As a result, the keycap 60B attached to the mounting parts 45 is also situated upward. The arm 72C is situated apart from the contacts 81*b* and 82*b*, so that the key-switch 10B is in the off state.

In the operating state, pressing the keycap 60B downward causes the keycap 60A to urge the mounting parts 45 downward, resulting in the downward movement of the mounting parts 45. Upon the downward movement of the mounting parts 45, the sliding parts 43 move outwards in the B2 directions despite the resisting elastic force of the arms 72.

As a result of the outward movement of the sliding part 43C, the arm 72C in contact with the sliding part 43C elastically deforms so as to come in contact with the contacts 81*b* and 82*b* as illustrated in FIG. 13. The contacts 81*b* and 82*b* are electrically connected with each other through the arm 72C, so that the key-switch 10B is placed in the on state.

When the operator stops pressing and releases the keycap 60B, the elastic forces of the arms 72 move the link mechanism 40 in the opposite direction from the time of pressing, so that the keycap 60B moves upward to return to the non-operating state.

As described above, the key-switch 10B of the present embodiment has the mounting parts 45A through 45D disposed in a square or rectangular shape to support the keycap 60B similarly to the key-switch 10A. With this arrangement, irregular movement of the keycap 60B due to looseness is avoided even when the operator presses the keycap 60B at a position off the center.

Further, the key-switch 10B of the present embodiment has an electric switch that is constituted by the terminals 81 and 82 disposed on the base member 30 and the spring 70 having the arms 72. The links of the present embodiment are urged by the arms 72. This arrangement obviates the need for a membrane switch and a rubber actuator in the key-switch 10B.

The elimination of the need for a membrane switch and a rubber actuator allows the LED 22 to be disposed at the center of the key-switch 10B, thereby enabling the use of the key-switch 10B as an illuminating switch.

Moreover, there is no need to dispose a rubber actuator at the center of the key-switch, and the mounting parts arranged in a square or rectangular shape support the keycap. Because of this, an opening such as a light-transmissive opening may be formed at the center of the keycap.

Although the present embodiment has been directed to an example in which the key-switch 10B is used as an illuminating switch by providing the opening 66 through the keycap 60B, the keycap 60B may be formed of light-transmissive material without the opening 66.

Further, the configuration utilizing the spring and the terminals 81 and 82 to provide an electrical switch and the configuration utilizing the opening formed at the center of the keycap in the present embodiment do not have to be combined with each other.

According to at least one embodiment, a tactile key feel is improved.

Further, the present invention is not limited to these embodiments, but various variations and modifications may be made without departing from the scope of the present invention.

The present application is based on and claims the benefit of priority of Japanese priority application No. 2015-195014 filed on Sep. 30, 2015, with the Japanese Patent Office, the entire contents of which are hereby incorporated by reference.

What is claimed is:

1. A key-switch, comprising:

a keycap configured to be pressed down;

a base member; and a link mechanism disposed between the keycap and the base member and configured to support the keycap such that the keycap is movable up and down relative to the base member, wherein the link mechanism includes four links arranged in a rectangular shape, and each of the links includes a sliding part configured to slide on the base member, a mounting part attached to the keycap, and joints connecting adjacent links among the four links together.

2. The key-switch as claimed in claim 1, wherein the joints include a convex part formed at one end of the mounting part and a concave part formed at another end of the mounting part, the concave part of one of the links being configured to engage rotatably with the convex part of another one of the links.

3. The key-switch as claimed in claim 1, further comprising a membrane switch having a rubber actuator disposed thereon, wherein the base member has an opening through which the rubber actuator passes through, and the rubber actuator situated in the opening is in contact with the keycap.

4. The key-switch as claimed in claim 1, further comprising an electrical switch formed on the base member, and is turned on and off in response to sliding movement of the sliding part.

5. The key-switch as claimed in claim 1, wherein the four links are attached to the keycap through the respective mounting parts of the four links such that the four links are movable relative to the keycap around four pivot axes, respectively, the four pivot axes being arranged in a rectangular shape.

6. The key-switch as claimed in claim 1, wherein the joints are configured such that movement of a given one of the four links mechanically causes movement of two links immediately adjacent to the given one of the four links.

* * * * *